US005412846A

United States Patent [19]

Hauner

[11] Patent Number: 5,412,846

[45] Date of Patent: May 9, 1995

[54] DRAW FRAME FLEECE HOPPER INCLUDING A WEAR RESISTANT INSERT

[75] Inventor: Friedrich Hauner, Ingolstadt, Germany

[73] Assignee: Rieter Ingolstadt Spinnereimaschinenbau AG, Ingolstadt, Germany

[21] Appl. No.: 128,608

[22] Filed: Sep. 29, 1993

[30] Foreign Application Priority Data

Oct. 22, 1992 [DE] Germany ..... 42 35 653.9

[51] Int. Cl.[6] ..... D01H 5/72

[52] U.S. Cl. ..... 19/288; 19/150

[58] Field of Search ..... 19/150, 157, 236, 238, 19/286, 288, 294, 159 R, 301

[56] References Cited

U.S. PATENT DOCUMENTS

| | | | |
|---|---|---|---|
| 549,956 | 11/1895 | Canning | 19/150 |
| 1,019,273 | 3/1912 | Owen | 19/150 |
| 1,102,298 | 7/1914 | Schofield | 19/150 |
| 2,737,692 | 3/1956 | Rogers | 19/150 |
| 3,255,495 | 6/1966 | Smith, Jr. | 19/150 |
| 3,362,049 | 1/1968 | Kiser | 19/150 X |
| 3,411,284 | 11/1968 | Corbaz et al. | 19/150 X |
| 3,562,863 | 2/1971 | Fornes | 19/288 X |
| 3,840,942 | 10/1974 | Thomason, Jr. | 19/150 |
| 3,895,417 | 7/1975 | Zimmermann, Jr. | 19/288 |
| 4,905,352 | 3/1990 | Gunkinger et al. | 19/159 R |

FOREIGN PATENT DOCUMENTS

| | | | |
|---|---|---|---|
| 0098556 | 11/1924 | Austria | 19/150 |
| 2623400 | 3/1977 | Germany . | |
| 3344710 | 6/1984 | Germany | 19/288 |
| 609753 | 10/1948 | United Kingdom . | |
| 2132240 | 7/1984 | United Kingdom | 19/288 |

OTHER PUBLICATIONS

Rieter Ingolstadt Operating Manual, Aug., 1990, p. 28, FIGS. 7A, 7B.

Copies of Photographs of RSB 851, Rieterer Ingolstadt Operating Manual, Aug., 1990.

*Primary Examiner*—Clifford D. Crowder
*Assistant Examiner*—Ismall Izaguirre
*Attorney, Agent, or Firm*—Dority & Manning

[57] ABSTRACT

A fleece hopper of a textile draw frame is located between a pair of draw-off rollers and a fiber sliver pipe. Fiber fleece is gathered together in the hopper and deflected into the hopper outlet. The hopper outlet includes a pipe-shaped insert removably fitted therein. The insert can be removed and replaced without disturbing or adjusting the hopper itself.

9 Claims, 2 Drawing Sheets

DRAW FRAME FLEECE HOPPER INCLUDING A WEAR RESISTANT INSERT

BACKGROUND OF THE INVENTION

The instant invention relates to a fleece hopper on a draw frame of the textile industry. The fleece hopper is located at the output of a textile draw frame.

In a draw frame, the fiber fleece delivered by the pair of delivery rollers is conveyed into the fleece hopper. There, the fiber fleece is gathered together and leaves the fleece hopper in the form of a fiber sliver. The fiber sliver is immediately conveyed on in a fiber sliver pipe leading to a sliver hopper which is located before a calendar roller pair. The calendar roller pair conveys the sliver into a depositing device which deposits the fiber sliver in the can. The draw frames RSB 851 (4135) and SB 851 (4131) of Rieter Ingolstadt are examples of such draw frames and the Operating Manual, August 1990, page 28, 4.4.3.2, FIGS. *7a, 7b* for the RSB and SB draw frames explains these principles.

The fleece hopper is made of one massive piece of brass. As a result the production costs are relatively low. The fleece hopper is designed so that its width is greater than its height. It is provided with a centered cylindrical bore which acts as a hopper pipe. The hopper is adjusted to the center of the draw-off roller to ensure optimal entry of the fleece into the hopper bore. The adjustment requires different adjustment calibers for fleece hoppers with different hopper bore diameters (see RSB 851 (4135), SB 851 (4131), Operating Manual, August 1990, page 28, 4.4.3.2, FIG. *7b*).

At the fiber sliver delivery speeds that are common today, intense friction of the fleece occurs at the deflection point between hopper side and hopper bore. The fleece is gathered together at the hopper side and is deflected into the bore. The result of the friction is material wear at the deflection point. This material wear is very detrimental since it affects the incoming fiber fleece adversely. Grooves are formed at the surface of the material, impeding entry. Replacement of the entire fleece hopper while the machine is stopped is required. No other measures for the elimination of wear have been found. Furthermore, when a new fleece hopper is installed, it is necessary to adjust it anew. This outlay of material and time is a disadvantage.

OBJECTS AND SUMMARY OF THE INVENTION

It is a principal object of the instant invention to reduce the maintenance outlay caused by the wear of the fleece hopper. Additional objects and advantages of the invention will be set forth in part in the following description, or will be obvious from the description, or may be learned by practice of the invention.

It is a characteristic of the invention that the hopper outlet is made substantially larger than conventional hoppers so that replaceable pipe-shaped inserts with a cylindrical bore can be inserted form-fittingly. The original hopper outlet is enlarged so as to be able to receive the replaceable, pipe-shaped insert. The insert itself is provided with a cylindrical bore with the desired diameter for fiber-sliver through-put. The insert is form-fitting and can be pushed into the hopper inlet until an end position is reached. The end position is reached in the form of a stop in the fleece hopper. The stop is fixed in this end position. In this end position the insert adjusts itself in a form-fitting manner to the fleece hopper. The insert thus acts as a hopper pipe. It is essential that the insert be provided with a cylindrical bore while the manner in which the circumferential surface of the pipe-shaped insert is fashioned is unimportant. When material wear has occurred on the insert, the later is simply replaced. During the replacement of the insert the fleece hopper remains in its adjusted position. The solution is advantageous because the entire fleece hopper need not be replaced and readjusted after replacement.

It is a further characteristic that the insert is made of a wear-resistant material. Either the mass of the insert is made of a wear-resistant material or only its surface is coated with this material. Special steel or ceramic is such a wear-resistant material. These measures increase the wear resistance of the insert while extending its life. Although the insert is made of an expensive, high-grade material, its utilization becomes more economical because much less material is being used than if the fleece hopper as a whole were to be made of an expensive and high-grade material.

An additional advantage is the fact that even when batches are changed on the draw frame, only an insert with a corresponding cylindrical bore need be inserted. The change-over time for the fleece hopper is advantageously shortened when batches are changed.

Although inserts with different cylindrical bores are used, the configuration of their pipe circumference is not tied to any particular form. This has the further advantage that only one single adjusting caliber is required to adjust the basic body of the fleece hopper (at installation), i.e. an adjusting caliber which corresponds to the dimension of the hopper outlet of the fleece hopper (without insert).

The invention is described below through the preferred embodiment. The embodiment of the invention is represented through drawings which are incorporated in the description.

DETAILED DESCRIPTION OF THE PREFERRED EMBODIMENTS

Figure 1:
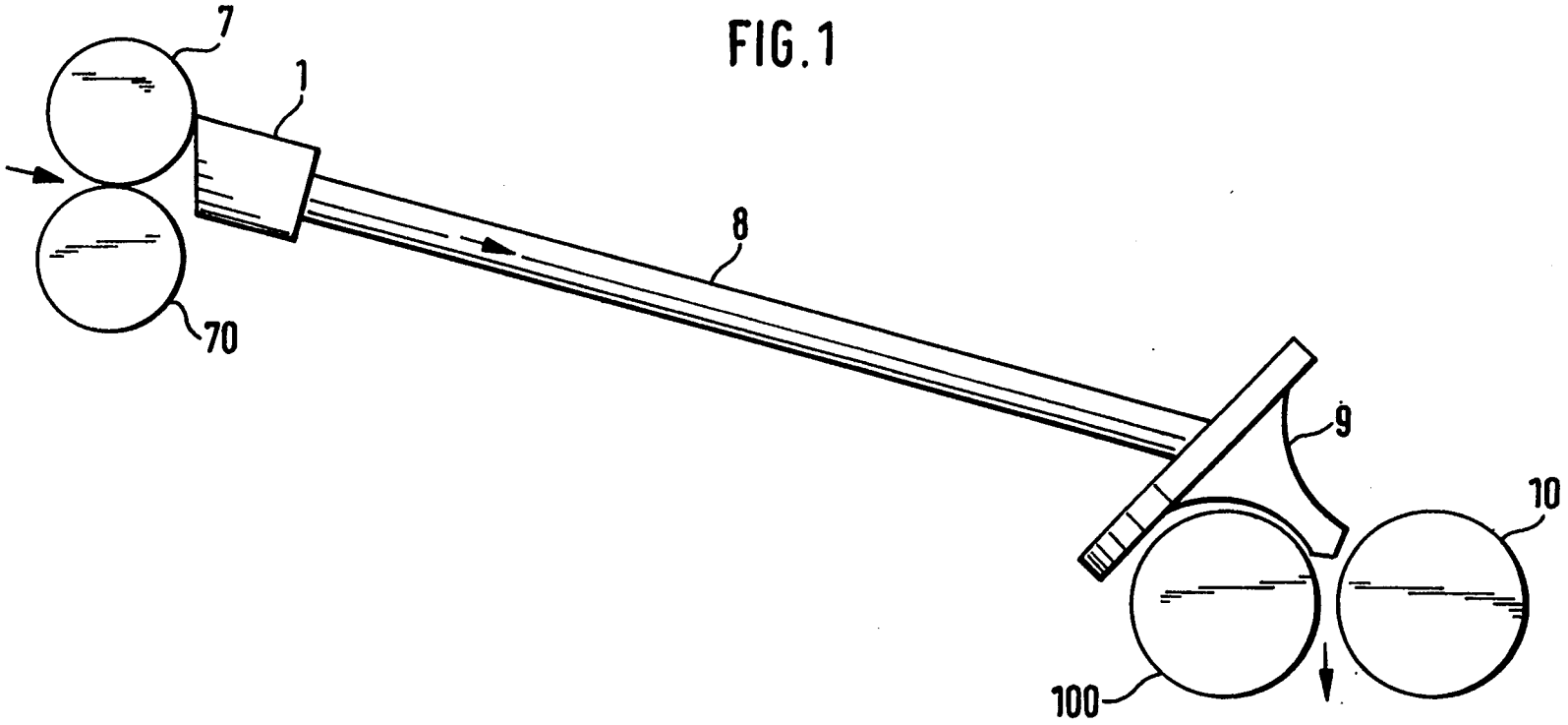
FIG. 1 shows the schematic arrangement of the fleece hopper at the output of a draw frame.

Reference will now be made in detail to the presently preferred embodiments of the invention, one or more examples of which are illustrated in the drawings. Each example is provided by way of explanation of the invention, not limitation of the invention. The number of components in the drawings is consistent throughout the application, with the same components having the same number in each of the drawings.

A pair of output rollers 7, 70 is installed at the output of a draw frame. This pair of output rollers 7, 70 conveys the fiber fleece into the fleece hopper 1. The fiber fleece is gathered together in the fleece hopper 1 and is conveyed on through the hopper inlet to the fiber sliver pipe 8. The fiber sliver is conveyed on into a fiber sliver hopper 9. At the output of the fiber sliver hopper 9 the fiber sliver is seized by a pair of calendar rollers 10, 100 and is conveyed on to the depositing device of the draw frame. The arrows in FIG. 1 show the direction of transportation of the textile material.

Figure 4:
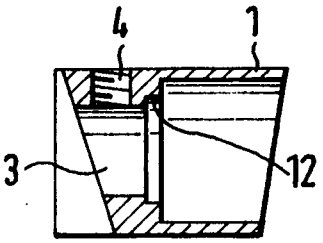
FIG. 4 shows a section view taken along lines A–B of FIG. 3.
Figure 5:
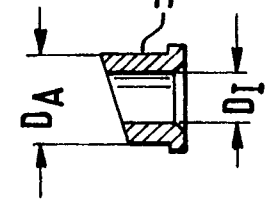
FIG. 5 shows a longitudinal section of an insert.
Figure 6:
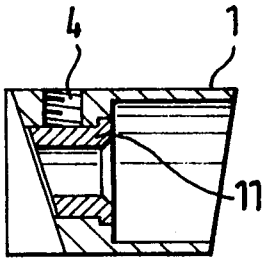
FIG. 6 shows a section of a fleece hopper with the insert inserted.
Figure 3:
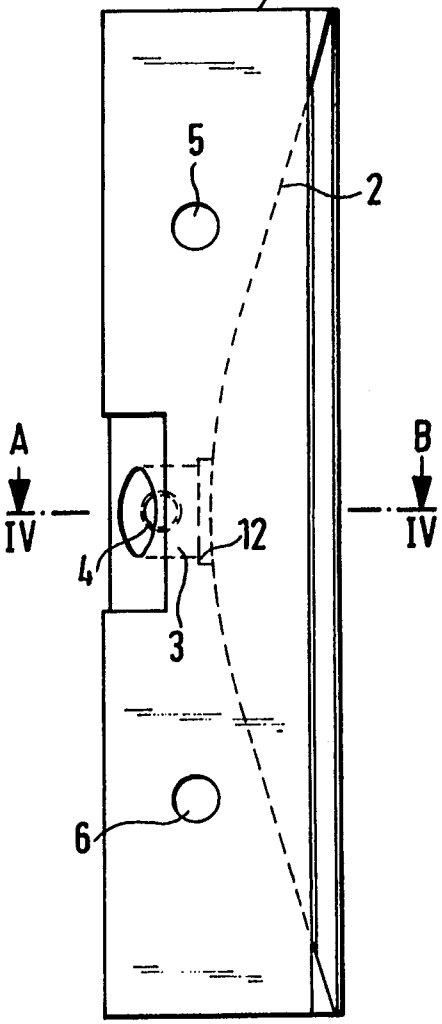
FIG. 3 is a top view of the fleece hopper with removed insert.
Figure 2:
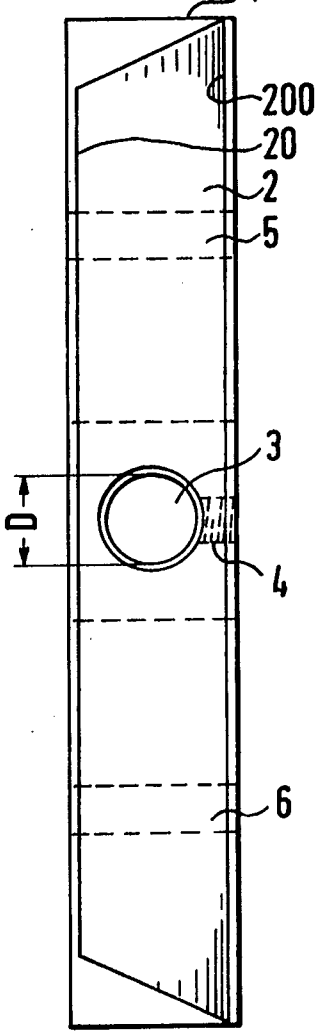
FIG. 2 shows the fleece hopper with removed insert from the perspective of the entering fiber fleece.

FIG. 2 shows the fleece hopper 1 as seen from the perspective of the entering fiber fleece. The fleece hopper 1 is not perfectly round but is essentially rectangular in form. The hopper is delimited by the hopper sides 2, 20, 200. In the center of its basic rectangular form a hopper bore 3 is provided in the fleece hopper 1. This hopper bore 3 is connected to a threaded bore 4 which is offset by 90°. This hopper bore 3 is necessary in order to be able to receive the insert 11 according to FIG. 5. The possibility of receiving the insert 11 is an essential point of the invention. It is not important for the invention whether the hopper bore 3 is cylindrical or has some other form, e.g. a conical or angular form. The primary condition is that it should be able to receive the pipe-shaped insert. In the example, a cylindrical bore 3 was chosen. To attach the fleece hopper 1 to the draw frame, the mounting bores 5, 6 are provided. The hopper bore 3 has a diameter D which is equal to the outside diameter $D_A$ (according to FIG. 5) of the insert 11. This hopper bore 3 is able to receive the insert 11 as shown in FIG. 5 in a form-fitting manner. The form-fitting reception of the insert 11 in the fleece hopper 1 is shown in FIG. 6. As can be seen, the insert 11 is inserted form-fittingly into the fleece hopper 1 in an end position. As FIGS. 3 and 4 indicate, the hopper bore 3 is provided with a stop 12. The insert 11 is pushed into the hopper bore 3 when it is being installed, i.e. in the direction of transportation of the textile material. The insert 11 is in its end position when its projecting rim comes into contact with the stop 12. The insert 11 is always pressed against stop 12 by the entering fleece and is fixed at the same time in that position. In order to prevent twisting of the insert 11, the twisting of insert 11 is prevented by screwing a threaded screw into the threaded bore 4. The insert 11 acts as a hopper pipe.

To replace the insert, the threaded screw in the threaded bore 4 is loosened and the insert 11 is pressed out of its end position in a direction opposite to the direction of transportation of the fiber fleece. The fleece hopper remains at the same time in its original adjusted position.

The replaceable insert 11 consists of a high-grade, wear-resistant material such as, e.g., special steel or ceramic. The insert can however also be made of a different metal core whose surface is coated with a wear-resistant material. The replacement of the insert 11 becomes necessary when wear becomes apparent at its surface. Replacement is time-saving, since the entire fleece hopper need not be removed and readjusted. This solution also contributes to lowering material costs. The invention furthermore has the advantage that in particular when batches are changed, the fleece hopper 1 need not be replaced as would normally be the case, but only the insert 11 must be replaced. In case of a batch change, the insert 11 would have an appropriately different inside diameter $D_I$.

Since its outside diameter $D_A$ is equal to the diameter D of the hopper bore 3, time and material can also be saved with respect to the fleece hopper 1.

It will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents.

I claim:

1. A fleece hopper for a textile draw frame, said fleece hopper configured to be disposed on a draw frame between a pair of draw-off rollers and a fiber sliver pipe wherein fiber fleece is gathered together in said hopper and directed through said hopper to the fiber sliver pipe, said hopper comprising an outlet through which the gathered fleece is directed, said outlet defining a bore therethrough, said hopper further comprising a pipe-shaped insert element removably fitted into said bore, said insert defining a wear resistant path for the gathered fleece through said hopper outlet, said hopper further comprising a securing mechanism for removably fixing said insert within said bore, said securing mechanism comprising a hole defined through a top surface of said hopper into and substantially perpendicular to said bore with an actuable engaging member extending through said engaging hole to contact said insert, said insert being removable from said hopper without changing or adjusting said hopper relative to the draw frame.

2. The hopper as in claim 1, wherein said bore comprises a form fitting opening, said insert comprising a form fitting outer circumferential surface complimenting said form fitting opening wherein said insert is removably form fitted into said bore.

3. The hopper as in claim 1, wherein said outlet defines an end position for said insert, said end position being defined by a stop element configured in said outlet.

4. The hopper as in claim 3, wherein said insert is form fitted within said bore and abuts said stop element.

5. The hopper as in claim 1, wherein said insert comprises a form fitting circumferential surface and defines a cylindrical inner diameter bore.

6. The hopper as in claim 1, wherein said insert is formed of a wear resistant material.

7. The hopper as in claim 1, wherein said insert comprises an inner circumferential surface defining a generally cylindrical path for said fleece, at least said inner circumferential surface comprising a wear resistant material.

8. The hopper as in claim 7, wherein said insert comprises a metal core component with a wear resistant material formed on said inner circumferential surface.

9. The hopper as in claim 1, wherein said engaging member comprises a threaded member threadedly engaged within said hole to contact and retain said insert in position within said bore.

* * * * *